United States Patent [19]

Stephan

[11] 4,355,927

[45] Oct. 26, 1982

[54] PILING STRUCTURE AND METHODS

[76] Inventor: Karl Stephan, 7151 Dearwester Dr., Cincinnati, Ohio 45236

[21] Appl. No.: 173,077

[22] Filed: Jul. 28, 1980

[51] Int. Cl.[3] ..... E02D 5/50; E02D 5/54

[52] U.S. Cl. ..... 405/233; 52/160; 405/244

[58] Field of Search ..... 405/237, 238, 231, 230, 405/233, 234–245, 250–253; 52/157, 160, 165

[56] References Cited

U.S. PATENT DOCUMENTS

| | | | |
|---|---|---|---|
| 219,618 | 9/1879 | Carley et al. . | |
| 226,237 | 4/1880 | Maclay . | |
| 307,541 | 11/1884 | Gray et al. | 405/253 X |
| 510,264 | 12/1893 | Kash . | |
| 891,448 | 6/1908 | Snider | 52/157 |
| 961,438 | 6/1910 | Goldsborough . | |
| 969,136 | 8/1910 | Cranford | 405/250 |
| 1,181,141 | 5/1916 | Johnson . | |
| 1,224,925 | 5/1917 | Hindmarsh . | |
| 1,443,306 | 1/1923 | Blumenthal . | |
| 1,501,643 | 7/1924 | Blumenthal . | |
| 1,558,127 | 10/1925 | Upson | 405/250 |
| 1,591,165 | 7/1926 | Hesse . | |
| 1,751,607 | 3/1930 | Smith . | |
| 2,067,890 | 1/1937 | Collord . | |
| 2,121,757 | 6/1938 | Heinrich et al. | 52/160 |
| 2,122,584 | 7/1938 | Peck . | |
| 2,140,111 | 12/1938 | Newman . | |
| 2,174,436 | 9/1939 | Cappel . | |
| 2,187,319 | 1/1940 | Greulich . | |
| 2,373,276 | 4/1945 | Thornley . | |
| 2,497,377 | 12/1950 | Swann . | |
| 2,570,646 | 10/1951 | Cole | 52/160 |
| 2,644,668 | 7/1953 | Carpenter . | |
| 2,805,553 | 9/1957 | Allard . | |
| 2,947,149 | 8/1960 | Barkley . | |
| 3,034,304 | 5/1962 | Upson | 405/243 |
| 3,184,893 | 5/1965 | Booth . | |
| 3,191,390 | 6/1965 | Schutte . | |
| 3,270,469 | 9/1966 | Debiton . | |
| 3,279,136 | 10/1966 | Smith . | |
| 3,303,244 | 2/1967 | Talley et al. | 405/243 X |
| 3,324,666 | 6/1967 | Lee . | |
| 3,464,215 | 9/1969 | Spanovich . | |
| 3,496,729 | 2/1970 | Pleuger . | |
| 3,568,452 | 3/1971 | Stifler . | |
| 3,621,663 | 11/1971 | Otani . | |
| 3,680,274 | 8/1972 | Deike . | |
| 3,691,776 | 9/1972 | Hull . | |
| 3,763,655 | 10/1973 | Galuska . | |
| 3,793,844 | 2/1974 | Chelminski . | |
| 3,832,859 | 9/1974 | Kanjanavanit . | |
| 3,975,917 | 9/1976 | Asayama . | |
| 4,033,006 | 7/1977 | Soffge . | |
| 4,047,356 | 9/1977 | DePirro . | |
| 4,060,994 | 12/1977 | Chitis . | |

FOREIGN PATENT DOCUMENTS

| | | |
|---|---|---|
| 676088 | 5/1939 | Fed. Rep. of Germany . |

*Primary Examiner*—Dennis L. Taylor
*Attorney, Agent, or Firm*—Wood, Herron & Evans

[57] ABSTRACT

An improved piling structure, for particularly advantageous use in sand or in sandy soils, has three elements including a pilot, a frusto-conical disk and a piling integrating the elements together. The disk is of preformed mesh reinforced cementitious material and is disposed on the driven pilot at the bottom of a hole, excavated for disk placement. The cementitious piling is poured onto the disk and pilot, integrating the structure. An alternate unitary pole support includes a hollow, lined casing, with a disk intermediate its ends, and an outer tube extending above the casing top to form a cementitious sleeve over the juncture of the casing and the pole. Methods of assembly and erection are included.

21 Claims, 7 Drawing Figures

PILING STRUCTURE AND METHODS

This invention relates to structural pilings and, more particularly, to improved structural piling apparatus and methods for use in weak load bearing environments such as loose soils and sand.

Loose soils, sand and other ground which is neither dense or firm enough to acceptable support normally driven pilings present special problems to supporting structures such as buildings and homes. In such environments, pilings tend to sink and to otherwise fail.

Thus, in areas with high concentrations of sand, such as in Florida, sound support is difficult to obtain. I have found it desirable to provide an improved piling which is particularly adaptable to such soils and which may be used in other environments as well, particularly when increased piling performance is desired.

Accordingly, it has been one objective of my invention to provide an improved piling.

A further objective of my invention has been to provide an improved piling for use in sand and in loose soils.

A further objective of my invention has been to provide a relatively inexpensive and easily installed piling structure which is particularly adaptable for use in sand and in loose soils.

Additionally, it is frequently desirable to mount poles such as telephone poles, utility poles, flag poles, sign poles, tennis net supports, and the like in sand or in loose soils such as mentioned above. Such poles frequently are not vertically loaded to the same extent as building pilings, but they do bear larger bending or other horizontal loads as a function of their use. Wind loads on poles supporting flags or signs, for example, exert substantial bending forces on the poles involved. Of course, such loads are also present regardless of the soil in which they are mounted. In the past, it has been necessary to pour large footings or pads to support and anchor such poles against these forces. Such footings frequently require large excavations and unduly complicate pole erection.

Accordingly, it has been a further objective of the invention to provide an improved subsurface pole support.

A further objective of the invention has been to provide an improved pole support useful in any soil, but particularly in sand, sandy, or loose soils.

A still further objective of the invention has been to provide an improved pole support for mounting poles to supports securely against lateral or bending forces exerted on the poles.

To these ends, a preferred embodiment of my invention contemplates a composite piling of three basic parts, a driven pilot, a support disk, and a piling member thereon having a lower end integrating the pilot, the disk and the piling member. More particularly, a preferred embodiment of my invention includes a disk having a central aperture therein and a pilot having locating and securing elements, such as reinforcing rods, extending upwardly therefrom, through the aperture in the disk. The piling member is formed in situ and, when poured, the lower end fills the aperture in the disk, envelopes the securement elements, and serves to lock the three components together.

Since the disk is of significantly larger diameter than the piling, it rests on the sand, soil, or the like and constitutes a significant load bearing member. Its construction is important in view of this load bearing capacity.

Accordingly, a preferred disk is of a slightly frusto-conical shape and comprises a mesh reinforced cementitious material. Reinforcing nylon or fiberglass mesh elements, for example, are embedded in the upper, lower and edge surfaces of the disk and cooperate therewith to produce a strong load bearing member. This mesh has been found to substantially strengthen the disk against flex or failure when piling forces are exerted thereon. Together with the frusto-conical shape of the disk the embedded mesh produces a suitable vertical support for piling loads of the type described.

A circumferential flange depends downwardly from the outer edge of the disk and this flange, together with the pilot and the frusto-conical shape of the disk tends to position and hold the disk securely in place in sand and other soils. Such disk distributes the support piling load over a large area, and any settling of the disk enhances its load bearing support due to the frusto-conical shape, and the flanges capturing sand and soil thereunder.

In use, a hole slightly larger than the disk diameter is excavated to a predetermined depth and the pilot is driven to a preferred depth into the bottom of the hole. Alternately, the pilot is driven before the hole is excavated. In any event, the sand or soil surface surrounding the upper end of the pilot is shaped to receive and engage the lower side of the disk.

Secondly, the prefabricated disk is lowered into the hold over the pilot, the reinforcing rods entering the aperture in the disk and serving as a guide. When the disk is seated on the pilot, the piling is cast in situ onto the disk and the pilot, the bottom end of the piling having a central portion filling the disk aperture and enveloping the reinforcing rods. The lower end of the cementitious piling also has an outer portion, of greater diameter than the disk aperture, which sits on top of the disk adjacent the aperture. Lifting hooks, which are cast into the disk for lifting it, are also enveloped by the outer portion of the lower end of the piling adjacent the disk aperture to further secure the elements together.

Thereafter, the piling cures, thus integrating the three component pile structure, the bottom end of the piling permanently securing the pilot, disk and piling together. When a casing or form is used for casting the piling, it can be left on the piling when the hole is filled, but it is preferably of the removable type and is removed prior to filling the hole.

Accordingly, the improved piling provides a solution to the problem of providing substantial pile support, particularly in sand and loose soils. The reinforcing mesh of the disk, embedded in its surfaces as described herein, substantially strengthens the disk and permits relatively thin disks to be used. For example, in one embodiment, the pilot and the piling might each have a major diameter of about 1 foot, the pilot being about 3 feet long and having its upper end about 4 or 5 feet beneath the ground surface. A cementitious frusto-conical disk of about 3 feet in diameter and of about 4 inches thick, when made according to the description herein, provides substantial and acceptable support in sand for at least residential buildings using a plurality of such improved pilings.

The improved piling thus makes it possible to provide proper support and footing for buildings in sand and in loose soil areas where otherwise much more extensive and deeper excavation footing or structures would be required.

An alternate embodiment of my invention is particularly useful for supporting poles subject to lateral or bending forces. Such embodiment includes a preformed hollow casing with an integral frusto-conical disk extending radially outward therefrom intermediate upper and lower ends thereof. A corrugated lining having a closed lower end resides in the casing for receiving a pole. A tube is disposed over the upper end of this casing above the disk and extends above the casing.

In use, the support is driven into the bottom of a preformed holes of a diameter slightly greater than of the disk. A pole is inserted into the casing and cementitious material is filled into the spaces between the corrugated lining and the pole. Cementitious material is then filled between the tube and the casing and pole, forming a sleeve over the joint between the casing and pole. Finally, the hole is filled and the pole is thus securly mounted.

In a method for producing the preformed casing, a locating pin is centered in a disk closing the bottom end of the corrugated lining and the pin is extended into a centered position at the bottom end of the mold. This serves to center the corrugated lining and insures uniform side wall thickness of the hollow casing.

This construction provides an integral pole support offering vertical load bearing capability and substantial lateral or horizontal bending resistance. Of course, the disk can be mesh reinforced if desired, however, a single mesh element at the edge of the disk may be all which is required.

These and other advantages will become more readily apparent from the following detailed description of a preferred embodiment of the invention and from the drawings thereof in which.

Figure 1:
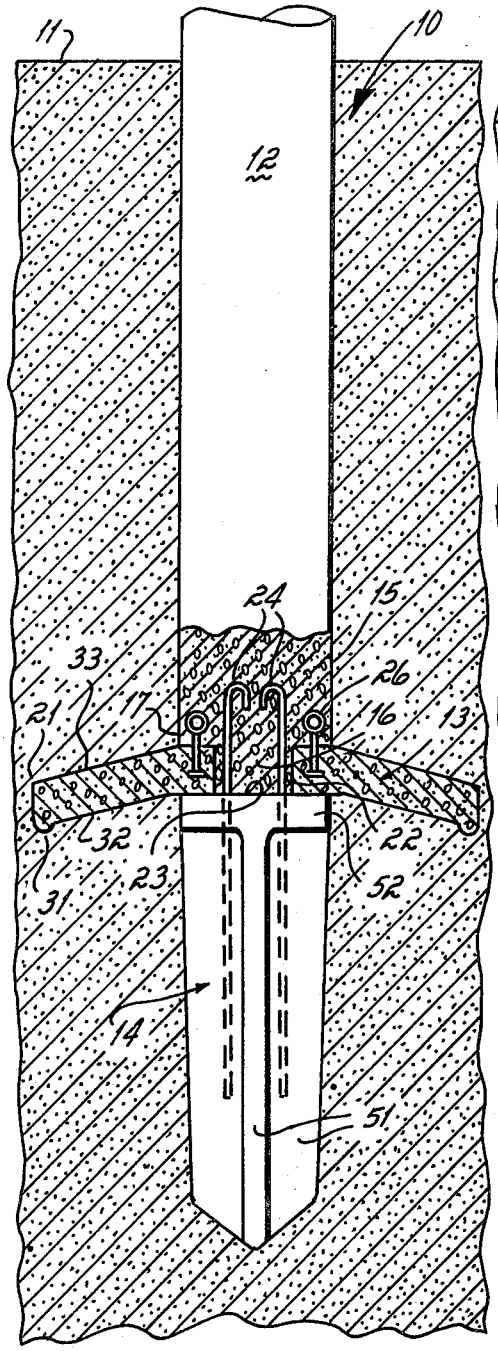
FIG. 1 is a cross-sectional view of piling structure according to the invention, illustrated in a fully assembled and in place condition.

Turning now to the drawings, there is shown in FIG. 1, a preferred piling structure 10 according to the invention. The piling structure 10 is shown in place in sand or loose soil having a surface 11. Primarily, the piling structure 10 includes three major components, a piling member 12, a disk 13 and a pilot element 14.

As shown in FIG. 1, the erected piling structure 10 comprises an integrated piling structure of three major components; the piling 12, the disk 13 and the pilot element 14 where are integrated together to form a solid substantial piling.

It will also be noted that the piling member 12 has a lower end 15 which serves to secure the piling member 12, the disk 13 and the pilot 14 together. To this end it will be appreciated that the lower end 15 of the piling member 12 has a central portion 16 and an outer portion 17, the central portion extending downwardly beyond the outer portion 17.

Figure 2:
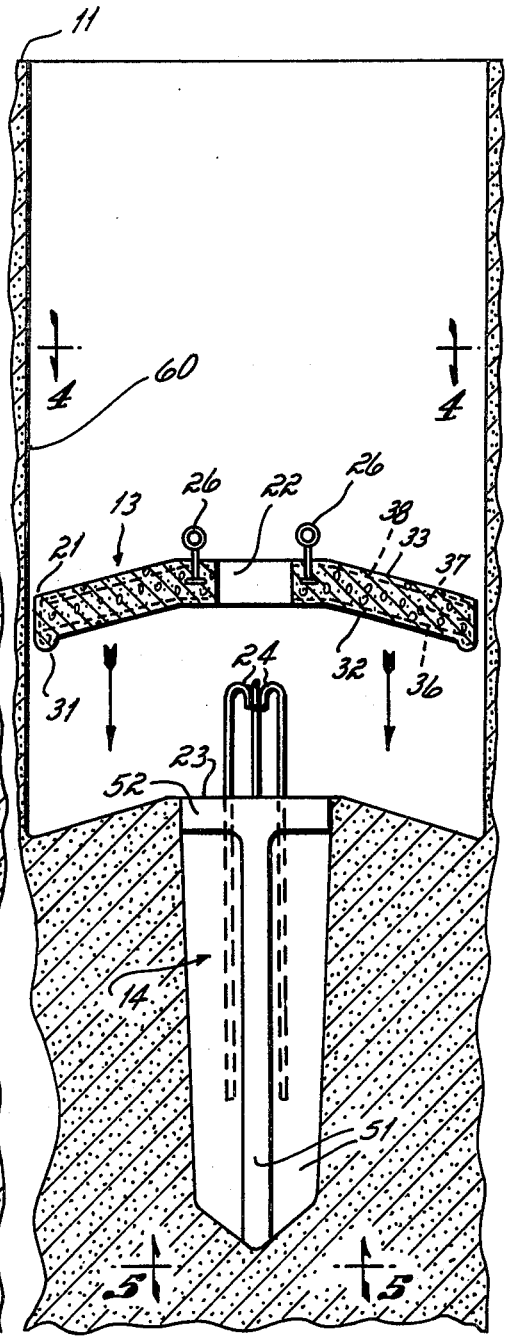
FIG. 2 is a cross-sectional view of the lower end of the piling structure according to the invention before the disk is seated and the piling member is formed.

The disk is perhaps best seen individually in FIG. 2 wherein the disk is shown as having a frusto-conical shape with the central portion of the disk projecting upwardly from the edge 21 of the disk. The disk 13 includes an aperture 22 in the central portion of the disk and, as shown in FIG. 1, the central portion 16 of the lower end 15 of the piling member 12 extends into the aperture 22 of the disk and resides on the upper end 23 of the pilot element 14. Also, it should be appreciated that the outer portions 17 of the lower end of the piling member 12 resides on the disk adjacent the aperture 22.

Figure 4:
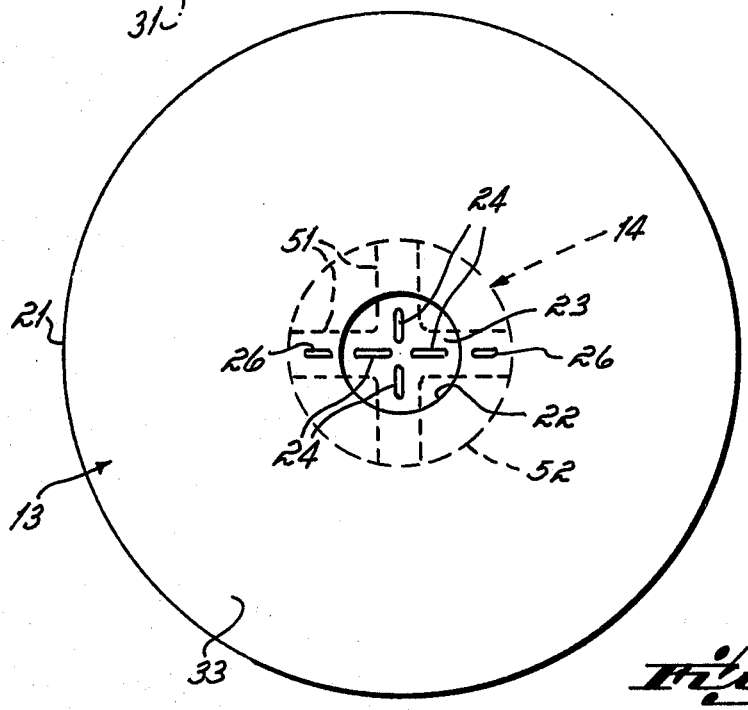
FIG. 4 is a top view taken along lines 4—4 of FIG. 2.

From FIG. 1 it will then be appreciated that the disk is effectively captured between the piling member 12 and the pilot element 14. Moreover, it will be appreciated that the pilot element 14 includes upwardly extending guiding and securement means in the form of reinforcing rods 24, four of which may be provided as illustrated in FIG. 4. Also, it will be noted that the disk 13 is provided with lifting means in the forms of hooks 26 which are formed in the disk for the purpose of providing means to lift it and to lower it onto the pilot element 14 as will be described. When the piling element is formed in place on the disk and the pilot, the lower end 15 envelopes both the reinforcing rods 24 and the hooks 26 thereby further integrating the three major components of the piling structure 10 together when the piling structure 10 is in place.

When the apparatus functions to serve as a building support, for example, it will be appreciated that downward forces are applied to the piling member 12, the lower end 15 of which resides on the disk and the pilot element 14. Since the disk 13 is of substantially greater diameter than both the piling member 12 and pilot element 14, and since the outer portions 17 of the piling member 12 rest on the central area of the disk, the downward force exerted on the piling member 12 are spread over a relatively large soil or sand area by means of the disk 13. Since the disk 13 is a substantial load bearing member, its construction is important to the efficient performance of the entire piling structure 10.

Figure 3:
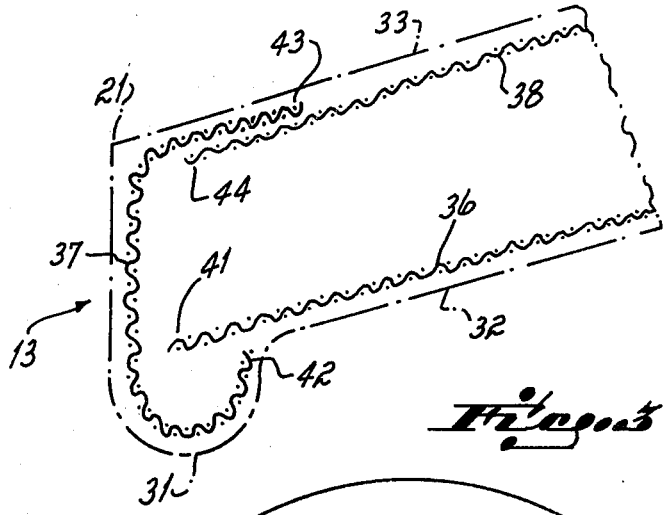
FIG. 3 is an expanded detailed view of the edge of the disk element of the piling structure of FIGS. 1 and 2.

Turning now to a more detailed description of the various features of the disk and having particular reference to FIGS. 2, 3 and 4, it will be particularly appreciated that the disk 13 is preferably of circular configuration, having a circumferential edge 21, and that the disk 13 is provided with a circumferential flange 31 which depends downwardly from the lower side 32 of the disk at its circular edge 21. When the disk is in place in the piling structure as shown in FIG. 1, the lower side 32 of the disk rests on the sand or the soil in which the piling structure is erected. Any downward pressure exerted on the disk by the piling member 12 is distributed throughout the disk and onto the sand or soil on which the disk rests. When the disk settles, the flange 31, taken in combination with the frusto-conical shape of the disk 13, tends to capture the sand, loose soil or other soil beneath the disk such that the disk is effective to limit any significant downward movement of the piling member 12. In order to strengthen the disk for the purpose of bearing piling loads, the disk is made from cementitious material of any suitable formulation and is reinforced with reinforcing mesh elements as will now be described.

The reinforcing mesh elements are shown diagrammatically in FIGS. 2 and 3. A first mesh element 36 is embedded in the lower surface 32 of the disk 13, a second mesh element 37 is embedded in the surface of the edge 21 of the disk 13, and a third mesh element 38 is embedded in the upper surface 33 of the disk 13. The mesh elements, together with the frusto-conical shape of the disk substantially strengthen the disk and enable it to bear the piling loads exerted thereon by the piling member 12. The relationship of the reinforcing mesh elements, particularly at the outer circular edges of the disk, also lend to the overall disk strength. More particularly, it will be appreciated that the reinforcing mesh elements have edges which are in overlapping relationship with other mesh elements. As shown in FIG. 3, first mesh element 36 has an outer edge 41 which extends into the area comprising the circumferential flange 31 of the disk, the second mesh element 37 has an edge 42 which overlaps the edge 41 of the first mesh element 36 as particularly shown in FIG. 3. The second mesh element 37 also has another edge 43 which overlaps edge 44 of the third mesh element 38, also as shown in FIG. 3. The mesh element may be made from any suitable material such as, for example, teflon, fiber glass or nylon. A suitable nylon mesh reinforcing material, for example, has a tensile strength of about 9000 pounds.

The disk 13 is preformed prior to being combined with the pilot element 14 and piling member 12. The disk can be made in suitable molds wherein the first mesh element 36 is placed in the bottom of the mold and the second mesh element 37 is placed along the side of the mold. Cementitious material can first be placed into the outer flange area of the mold corresponding to the circumferential flange 31, then the edges 41 of the first mesh element 36 can be laid thereon and the remainder of the mold filled. Thereafter, the third mesh element 38 can be laid on the uncured cementitious material and the edge 43 of the second mesh element 37 laid thereover, these last two mesh elements being also embedded in the surfaces of the cementitious material. Upon curing the mesh elements are embedded in the respective surfaces of the disk as described and substantially increase the strength of the disk to support loads exerted thereon by the piling member 12. Of course, the first mesh element 36 and the third mesh element 38 are themselves in disk form with central apertures therein so as to conform to basically the surfaces 32 and 33 of the disk. The second mesh element may be in the shape of an annulus with shaped edges.

Figure 5:
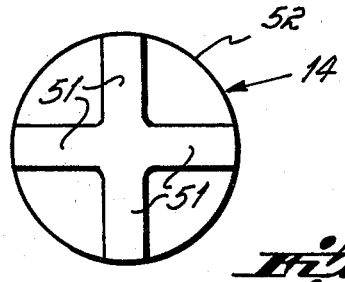
FIG. 5 is a bottom view of the pilot element taken along the lines 5—5 of FIG. 2.

Turning now to FIG. 5, it will be appreciated that the piling element 14 is fluted and has thereon longitudinal, radially extending ribs 51 which extend from the upper circular portion 52 of the pilot toward the bottom end thereof. These ribs constitute flutes which facilitate the driving of the pilot member and as well operate to secure the piling member against movement once it is in place.

Turning now to the construction of the piling structure 12, it will be appreciated that the pilot element 14 can be driven in any appropriate manner to a desired depth. In a preferred embodiment of the pilot structure 10, such as when it is used in sand or highly sandy soils, for example, a hole 60 (FIG. 2) is excavated of a diameter slightly greater than that of the disk 13. The pilot element 14 is then driven into the bottom of the hole to a depth of about four or five feet beneath the surface 11 of the ground. For this purpose a driven sleeve or other adapter can be used to drive the pilot. The pilot element itself is preferably about three feet long and about one foot in major diameter, at least at its top circular portion 52.

Of course, the pilot could be driven before the hole is excavated, and to a depth which approximates that to which the upper end of the pilot must be driven. In any event, a hole 60 is of a diameter slightly greater than that of disk 13 is excavated above the pilot for receipt of the disk. During such excavation, the bottom of the hole can be conformed to a frusto-conical shape so as to conform directly to the lower surface 32 of the disk to be laid on the pilot.

A prefabricated and cured disk 13 is lifted by means of the hooks 26 and is lowered into the hole 60 onto the pilot 14. During the lowering procedure, the upwardly projecting reinforcing rods extend through the aperture 22 of the disk and serve to guide the disk into its appropriate position on the pilot 14. Once the disk 13 is lowered onto the pilot, the four projecting rods 24, extending through the aperture 22, serve to maintain the disk in its approximately centered position over the pilot.

Thereafter, the piling member 12 is formed on the disk and the pilot. In this regard, the piling 12 is also preferably formed from any appropriate cementitious material. A preferably removable casing or sleeve (not shown) is erected over the disk and the pilot in the position in which the piling member is to occupy and the cementitious material is poured into the casing to form the piling member 12. As the material flows into the casing, it flows onto the disk and through the aperture 22 onto the upper portion 52 of the pilot 14, thus forming the central portion 16 of the bottom end 15 of the piling member. In addition, the casing or form is of such a diameter as to permit the material to also flow onto the top of the disk adjacent the aperture 22, thereby forming the outer portion 17 of the lower end 15 of the piling member. The casing or form is then filled to the desired height and the piling is cured.

It will be appreciated that when the piling is poured, the piling material envelopes both the reinforcing rods 24 and the hooks 26 thereby integrating the piling member, the disk and the pilot together. Once the piling is cured, the sleeve or casing, if of a removable variety, is removed and the hole 60 is filled thereby completing the piling construction operation.

While the piling structure 10 is suitable for use in many varied kinds of soil conditions, it is particularly useful in sand or in very loose sandy or other loose soil conditions. In this regard, a pilot element of about three feet in length and one foot in diameter, a disk element of about three feet in diameter and thickness of about four inches, and a piling member of approximately one foot in diameter and being at least about four or five feet in length between the upper surface 11 of the ground and the disk is believed appropriate for supporting, for example, residential houses or buildings in sand or in sandy soil areas, the disk providing substantial piling support for the structure to be loaded onto the piling member 12.

It will be appreciated that utilization of the piling structure 10 makes it unnecessary to utilize excessively longer piling elements or to perform other extensive excavations and footing structures in order to provide adequate support in such sand or loose soils. This makes it possible to erect buildings in very sandy or loose soil areas where the expense of the footings or pilings was heretofore excessive or prohibitive, the present invention providing a much less expensive and much less extensive piling structure.

ALTERNATE EMBODIMENT

Figure 6:
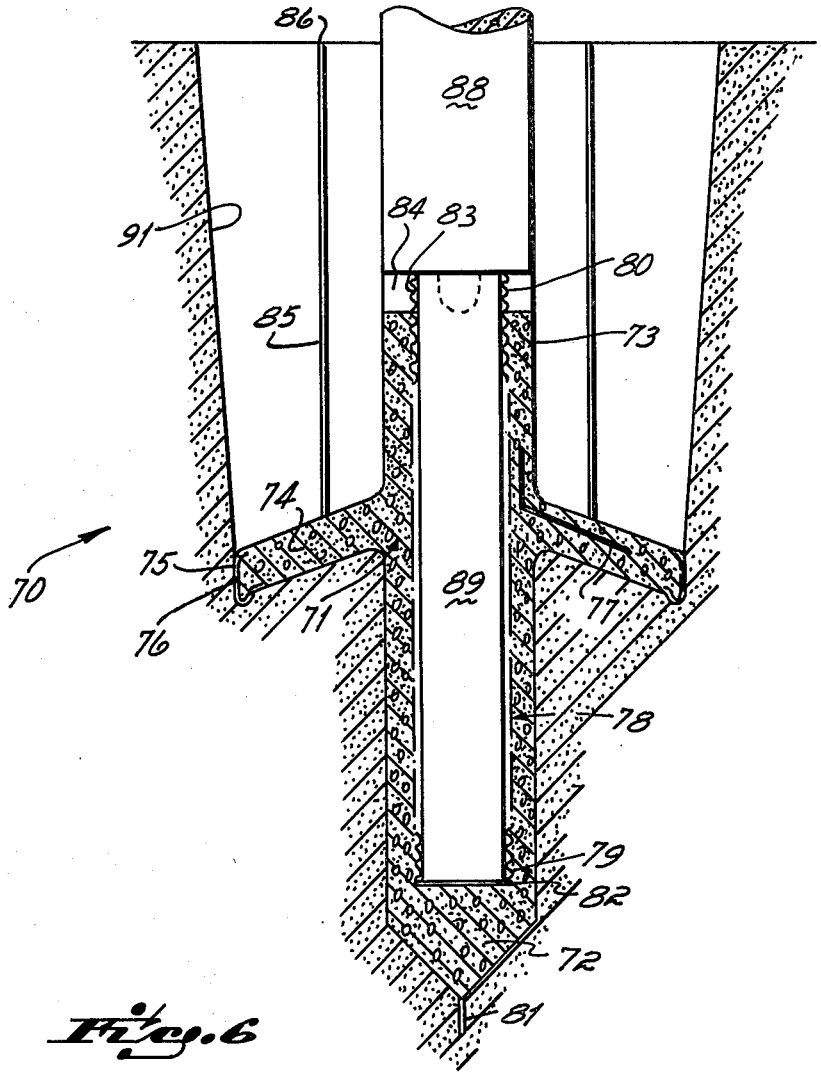
FIG. 6 is a diagrammatic side view of an alternate embodiment of the invention showing the structure before the cementitious material is poured and before the hole is back filled.
Figure 7:
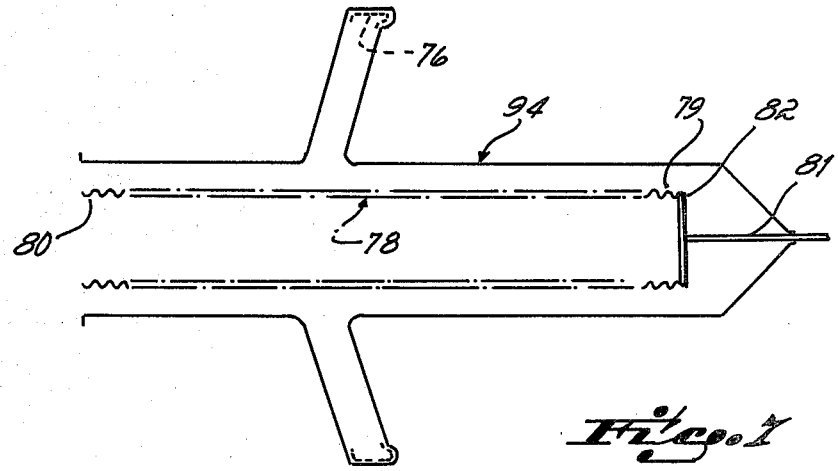
FIG. 7 is a diagrammatic view illustrating a method of making the alternate embodiment of the invention.

An alternate embodiment of the invention is depicted in FIGS. 6 and 7. Considering first FIG. 6, it will be appreciated that many pile or pole applications impose substantial bending or horizontal forces on the pile or pole itself and on the mountings for them. In addition, it will also be appreciated that it is frequently desired to mount a pole in very sandy or in loose soils. Such poles, for example, may be telephone poles, flag poles, or the like where the poles bear, for example, substantial wind or other loadings which tend to bend the poles. The particular pole support 70 depicted in FIG. 6 is particularly adapted for such applications.

Pole support 70 includes a cylindrical hollow casing 71 preferably made of cementitious material and having a pointed and closed lower end 72, and an open upper end 73. Intermediate the upper and lower ends of the support, and extending radially outward from the casing is a frusto-conically shaped disk 74. The disk 74 has an outer circumferential surface comprising a circumferential edge 75 of the disk. Embedded in the surface of edge 75 is a reinforcing mesh material such as nylon webbing 76 for the purpose of reinforcing the edge of the disk. Other pieces of reinforcing mesh material may be embedded in the upper and lower surfaces of the disk if so desired. Additionally, reinforcing rods, such as those illustrated at 77, may be disposed in the disk, extending into the wall of casing 71.

The hollow casing 71 includes an internal lining 78 which may be provided in a form of a corrugated tube or lining as shown in FIG. 6. The corrugated lining 78 is preferably metal and has a closed bottom end 79 and an open upper end 80. As shown in FIG. 6, a pin 81 extends through a disk 82 closing off bottom end 79 of corrugated lining 78. The pin extends through the disk 82 and through the closed end 72 of the casing 71. The pin 81 is useful in the formation of the supports 70 which will be hereinafter described.

The support 70 further includes an outer tube 85 having a diameter larger than the outside diameter of the hollow casing 71. The outer tube 85 extends upwardly from the disk 74 to a position above the upper open end 73 of the casing 71. When in place the upper end of the tube 85 may reside at about ground level or above or below ground level as desired. In FIG. 6, the upper end 86 of the tube 85 is disposed at ground level.

The support 70 is useful for supporting a pole 88 which has a smaller diameter lower end 89 adapted for receipt within the lining 78. Accordingly, the diameter of the upper portion of the pole 88 is greater than that of the lower portion 89 and is preferably equal to the outer diameter of the casing 71 such that the pole may sit on the upper end 73 of the casing 71.

In use, the pole support and the pole are erected as follows. A hole 91, just larger than the diameter of the disk 74 is excavated in the place where the pole is to be erected. The hole is excavated to a depth approximately 3 to 5 feet below the level of the sand or the ground. After the hole is excavated, the lower end 72 of the casing 71 is driven into the bottom of the hole until the disk 74 rests on the bottom of the hole. Thereafter, a pole 88 is inserted into the casing 71 such that the lower end 89 of the pole is received within corrugated lining 78 of the support.

As shown in FIG. 6, the lower end 89 has a diameter which is approximately equal to the inside diameter of the lining 78. Of course, the tube 85 is disposed over the upper end 73 of the casing before the pole is inserted therein.

Once the lower end 89 of the pole has been received within the lining 78, cementitious material is forced through the slots 83 and 84 of the corrugated lining 78 and the upper end 73 of the casing. Cementitious material fills the spaces between the corrugated lining and the pole to firmly set the pole within the casing. Thereafter, cementitious material is also filled into the space between the tube 85 and the casing on the one hand, and the pole 88 and the casing 71 on the other hand, thereby providing a cementitious sleeve overlapping both the casing 71 from the disk upwardly and a substantial portion of the pole 88. This sleeve integrates the pole and the casing and serves to hold the two together, supporting the pole against any bending at its connection with the casing 71.

Accordingly then, the disk 74 provides substantial vertical support for the pole. The support 70 provides a substantial footing for the pole and supports the pole against bending loads exerted on an upper end thereof, such as for example, by a flag or by other horizontal stresses exerted thereon.

Turning now to a method for manufacturing the support 70 as illustrated in FIG. 6, FIG. 7 depicts a support mold 94 which may be formed of two or more parts for molding the casing 71 about the lining 78. In use, the lining 78 is positioned in the mold and centered therein so that the walls of the casing 71 are substantially uniform. To this end, the centering pin 81 is centered in the disk 82 at the bottom of the lining 78 and the pin is then supported in the bottom of the mold to center the lining therein. The upper end of the lining 78 may be centered in the mold in any suitable fashion. Thereafter cementious material is poured into the mold between the lining and the mold 94 to form the hollow casing 71 about the lining. Once cured, the mold can be removed and the support casing 71 is ready for use. Of course, during the molding process the reinforcing mesh 76 may first be inserted into the mold by any suitable means so that it becomes embedded in the surface of the disk at its edge, and, if desired, at its upper and lower surfaces as well in order to reinforce the disk. In this regard, the mold can be made in any manner of suitable elements to provide for the use of such mesh. While the notches 83 may be preformed in the corrugated lining, the notches 84 in the cementitious material of the upper end 73 of the casing 71 are formed by any suitable means during or after the mold process.

Of course, it should be appreciated that the invention can be modified to varying sizes of pilots, disks, pilings, and support casings and to various depths as will be desired without departing from the scope of the invention. Also, the embodiments herein can be used in many soils not particularly mentioned herein. These and other modifications and alterations will be readily appreciated by those of ordinary skill in the art without departing from the scope of the invention and the applicant intends to be bound only by the claims appended hereto.

I claim:

1. A composite piling for use in soils and sand, said piling comprising:

a pilot means;

a disk having an aperture extending therethrough, said disk disposed on said pilot means with said aperture positioned over an upper end of said pilot means;

a piling member having a lower end secured to with both said disk and said pilot means for support of said piling member said pilot means having a diameter and said disk having a diameter at least about twice as great as said pilot means diameter.

2. Apparatus as in claim 1 wherein said disk comprises mesh reinforced cementitious material.

3. Apparatus as in claim 2 wherein each disk includes a first mesh reinforcing element on a lower side of said disk, a second mesh reinforcing element around an edge of said disk and a third mesh reinforcing element on an upper side of said disk.

4. Apparatus as in claim 3 wherein said mesh reinforcing elements have reinforced edges and wherein reinforced edges of each element overlap adjacent edges of other elements.

5. Apparatus as in claim 4 wherein said mesh reinforcing elements are embedded in said cementitious material.

6. Apparatus as in claim 1 wherein said disk includes a circumferential protrusion extending downwardly from the edge of the disk.

7. Apparatus as in claim 1 wherein said disk is frusto-conically shaped, outer edges being lower than the center area thereof.

8. Apparatus as in claim 1 wherein the lower end of said piling member includes a central portion extending through the aperture in said disk, and an outer portion abutting said disk adjacent said aperture.

9. Apparatus as in claim 8 wherein said pilot means includes projections extending upwardly therefrom through said aperture in said disk into said piling member.

10. Apparatus as in claim 9 wherein said piling member is secured to said pilot means by said projections and said disk is captured between said piling member and said pilot means.

11. Apparatus as in claim 1 wherein said pilot means includes longitudinal radially projecting ribs thereon, extending from a lower end thereof to a point below the upper end of said pilot.

12. Apparatus as in claim 1 wherein said disk includes hook means projecting therefrom for lifting said disk onto said pilot means, said hook means embedded in said lower end of said piling member for securing said piling member to said disk.

13. A composite piling for use in soils and sand, said piling comprising:

a pilot means;

a frusto-conically shaped disk mounted on said pilot means, said disk having a central aperture extending therethrough and said disk being disposed over an upper end of said pilot means;

a piling member;

a locating and securing means extending upwardly from said pilot means through said aperture for locating said disk thereon and for securing said piling member thereto; and said piling member having a lower end, a portion of which extends through the aperture in said disk, said lower end enveloping said locating and securing means, and having another portion resting on said disk adjacent said aperture said pilot means having a diameter and said disk having a diameter at least about twice as great as said pilot means diameter.

14. A composite piling for use in soils and sand, said piling comprising:

a pilot means;

a piling member;

a frusto-conically shaped disk disposed on said pilot means and between it and said piling member, said disk having a central aperture extending therethrough, and said piling member having a portion extending through said aperture to rest on said pilot means said pilot means having a diameter and said disk having a diameter at least about twice as great as said pilot means diameter.

15. Apparatus as in claim 14 wherein said disk comprises mesh reinforced cementitious material including a first mesh element embedded in a lower surface of said disk, a second mesh element embedded in a circumferential edge surface of said disk, and a third mesh element embedded in an upper surface of said disk, said mesh elements substantially encasing and strengthening said disk.

16. Apparatus as in claim 15 wherein each of said mesh elements have edges overlapping edges of other mesh elements.

17. Apparatus as in claim 16 wherein said disk includes a circumferential flange extending downwardly from a circular edge of said disk, said second mesh element encasing said edge and said flange.

18. Apparatus as in claim 17 wherein said first mesh element has an edge extending into said flange.

19. A method of constructing a structural piling in soil including the steps of:

excavating a hole in said soil;

driving a pilot means into the ground at the bottom of said hole, said pilot means having a diameter lesser than said hole above said pilot means;

dropping a disk of greater diameter than said pilot means into said hole;

mounting said disk on said pilot means, said disk having a central aperture disposed over said pilot means;

pouring a cementitious piling of diameter less than said disk onto said disk, said piling having a lower end or portion of which fills said aperture in said disk, when poured, and another portion of which rests on said disk adjacent said aperture;

said lower end of said piling integrating said pilot, disk and piling.

20. A method as in claim 19 including the step of pouring said piling onto said pilot through said aperture in said disk, onto said disk, and around securing means extending upwardly from at least one of said pilot and said disk.

21. A composite piling as in claim 1 wherein each of said piling members and said pilot means has an outer diameter, and wherein said disk has an outer diameter approximately three times as great as that of one of said piling diameter and said pilot means diameter.

* * * * *